US005908224A

United States Patent [19]

Santos

[11] Patent Number: 5,908,224

[45] Date of Patent: Jun. 1, 1999

[54] VACUUMATIC CONCRETE PLANER

[76] Inventor: Antonio G. Santos, 17 Posooy Street, San Francisco Del Monte, Quezon City, Philippines

[21] Appl. No.: 08/846,542

[22] Filed: Apr. 29, 1997

[51] Int. Cl.[6] ..... E01C 23/088; B24B 55/10

[52] U.S. Cl. ..... 299/39.2; 125/13.01; 299/39.4; 451/352; 451/456

[58] Field of Search ..... 299/39.2, 39.4; 451/456, 352; 125/13.01

[56] References Cited

U.S. PATENT DOCUMENTS

| | | | |
|---|---|---|---|
| 3,146,558 | 9/1964 | Viescas | 451/456 X |
| 5,287,660 | 2/1994 | Bellati et al. | 451/352 |
| 5,605,381 | 2/1997 | Schmoock, Jr. et al. | 299/39.2 |

FOREIGN PATENT DOCUMENTS

| | | | |
|---|---|---|---|
| 8145 | 5/1906 | United Kingdom | 451/352 |

*Primary Examiner*—David J. Bagnell

[57] ABSTRACT

A vacuumatic concrete planer for preventing dust from escaping the dust collecting bag attached to the vacuum blower assembly . The vacuumatic concrete planer includes a wheeled housing, a motor being mounted to the housing, a grinder blade assembly being disposed towards the front end of the housing, and a vacuum blower assembly being disposed towards the rear end of the housing. The grinder blade assembly and the vacuum blower assembly are operated by the motor through pulleys and belts being provided thereon. The grinder blade assembly comprises a shaft being held rotatably within the housing by suitable bearings. A plurality of laminated and fiberglass reinforced disc-like cutting stones are keyed to the shaft and protrude from the open bottom portion of the housing. The stones are securely held on the shaft by opposing counter balance washers and lock nuts. A vacuum cleaner is mounted to the housing. The vacuum cleaner has a suction hose in communication with the vacuum blower assembly.

9 Claims, 1 Drawing Sheet

VACUUMATIC CONCRETE PLANER

BACKGROUND OF THE INVENTION

1. Field of the Invention

The present invention relates to pavement or concrete planers and more particularly pertains to a new vacuumatic concrete planer for preventing dust from escaping the dust collecting bag attached to the vacuum blower assembly 2. Description of the Prior Art The use of pavement or concrete planers is known in the prior art. More specifically, pavement or concrete planers heretofore devised and utilized are known to consist basically of familiar, expected and obvious structural configurations, notwithstanding the myriad of designs encompassed by the crowded prior art which have been developed for the fulfillment of countless objectives and requirements.

Known prior art pavement or concrete planers include U. S. Pat. No. 5,263,769; U.S. Pat. No. 4,878,713; U.S. Pat. No. Des. 309,613; U.S. Pat. No. 4,006,936; U.S. Pat. No. 4,834, 463; and U.S. Pat. No. 4,637,753.

Another related prior art pavement or concrete planer is the Republic of the Philippines Patent No. 28976 issued Jun. 30, 1995. In this prior vacuumated concrete planer, there are two primary drawbacks. First, the dust collected from the vacuum blower assembly of the vacuumated concrete planer always escapes from a bag attached on the tube thereof even if water is applied to the surface to be ground. This leads bronchial problems and illness to the user. Second, the unitary disc type cutting stone of the planer under this patent develops irregular grinding thickness due to irregular surfaces to be grind.

While these devices fulfill their respective, particular objectives and requirements, the aforementioned patents do not disclose a new vacuumatic concrete planer. The inventive device includes a wheeled housing, a motor being mounted to the housing, a grinder blade assembly being disposed towards the front end of the housing, a vacuum blower assembly being disposed towards the rear end of the housing, the grinder blade assembly and the vacuum blower assembly being operated by the motor through pulleys and belts being provided thereon, wherein the grinder blade assembly comprising a shaft being held rotatably within the housing by suitable bearings, a plurality of laminated and fiberglass reinforced disc-like cutting stones keyed to the shaft and protruding from the open bottom portion of the housing, the stones being securely held on the shaft by opposing counter balance washers and lock nuts, and a vacuum cleaner having a suction hose, the vacuum cleaner being mounted to the housing, the suction hose being in communication with the vacuum blower assembly.

In these respects, the vacuumatic concrete planer according to the present invention substantially departs from the conventional concepts and designs of the prior art, and in so doing provides an apparatus primarily developed for the purpose of preventing dust from escaping the dust collecting bag attached to the vacuum blower assembly.

SUMMARY OF THE INVENTION

In view of the foregoing disadvantages inherent in the known types of pavement or concrete planers now present in the prior art, the present invention provides a new vacuumatic concrete planer construction wherein the same can be utilized for preventing dust from escaping the dust collecting bag attached to the vacuum blower assembly.

The general purpose of the present invention, which will be described subsequently in greater detail, is to provide a new vacuumatic concrete planer apparatus and method which has many of the advantages of the pavement or concrete planers mentioned heretofore and many novel features that result in a new vacuumatic concrete planer which is not anticipated, rendered obvious, suggested, or even implied by any of the prior art pavement or concrete planers, either alone or in any combination thereof.

To attain this, the present invention generally comprises a wheeled housing, a motor being mounted to the housing, a grinder blade assembly being disposed towards the front end of the housing, a vacuum blower assembly being disposed towards the rear end of the housing, the grinder blade assembly and the vacuum blower assembly being operated by the motor through pulleys and belts being provided thereon, wherein the grinder blade assembly comprising a shaft being held rotatably within the housing by suitable bearings, a plurality of laminated and fiberglass reinforced disc-like cutting stones keyed to the shaft and protruding from the open bottom portion of the housing, the stones being securely held on the shaft by opposing counter balance washers and lock nuts, and a vacuum cleaner having a suction hose, the vacuum cleaner being mounted to the housing, the suction hose being in communication with the vacuum blower assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new vacuumatic concrete planer apparatus and method which has many of the advantages of the pavement or concrete planers mentioned heretofore and many novel features that result in a new vacuumatic concrete planer which is not anticipated, rendered obvious, suggested, or even implied by any of the prior art pavement or concrete planers, either alone or in any combination thereof.

It is another object of the present invention to provide a new vacuumatic concrete planer which may be easily and efficiently manufactured and marketed.

It is a further object of the present invention to provide a new vacuumatic concrete planer which is of a durable and reliable construction.

An even further object of the present invention is to provide a new vacuumatic concrete planer which is susceptible of a low cost of manufacture with regard to both materials and labor, and which accordingly is then susceptible of low prices of sale to the consuming public, thereby making such vacuumatic concrete planer economically available to the buying public.

Still yet another object of the present invention is to provide a new vacuumatic concrete planer which provides in the apparatuses and methods of the prior art some of the advantages thereof, while simultaneously overcoming some of the disadvantages normally associated therewith.

Still another object of the present invention is to provide a new vacuumatic concrete planer for preventing dust from escaping the dust collecting bag attached to the vacuum blower assembly.

Yet another object of the present invention is to provide a new vacuumatic concrete planer which includes a wheeled housing, a motor being mounted to the housing, a grinder blade assembly being disposed towards the front end of the housing, a vacuum blower assembly being disposed towards the rear end of the housing, the grinder blade assembly and the vacuum blower assembly being operated by the motor through pulleys and belts being provided thereon, wherein the grinder blade assembly comprising a shaft being held rotatably within the housing by suitable bearings, a plurality of laminated and fiberglass reinforced disc-like cutting stones keyed to the shaft and protruding from the open bottom portion of the housing, the stones being securely held on the shaft by opposing counter balance washers and lock nuts, and a vacuum cleaner having a suction hose, the vacuum cleaner being mounted to the housing, the suction hose being in communication with the vacuum blower assembly.

Still yet another object of the present invention is to provide a new vacuumatic concrete planer that provides a vacuum cleaner installed on the housing in communication with the vacuum blower assembly so that dust expelled by the vacuum blower is sucked by the vacuum cleaner to prevent dust from escaping from the dust collection bag.

Even still another object of the present invention is to provide a new vacuumatic concrete planer with a grinder assembly consisting of individual cutting stones so that whenever one section of the stones obtains an irregular surface, it can be easily replaced.

Even still another object of the present invention is to provide a new vacuumatic concrete planer which uses laminated and fiberglass reinforced sutting stones that are durable and long lasting.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
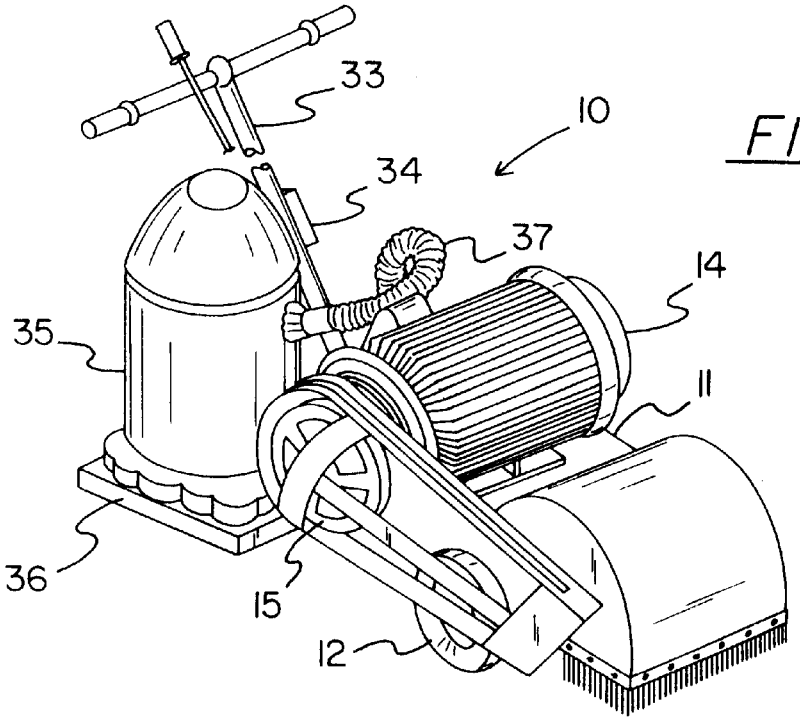
FIG. 1 is a perspective view of a new vacuumatic concrete planer according to the present invention.
Figure 3:
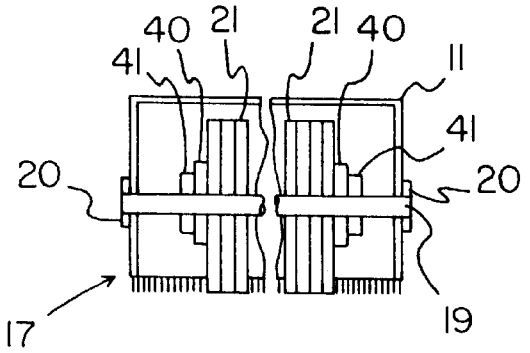
FIG. 3 is a sectional view of the present invention taken along line 3—3 of FIG. 2.
Figure 2:
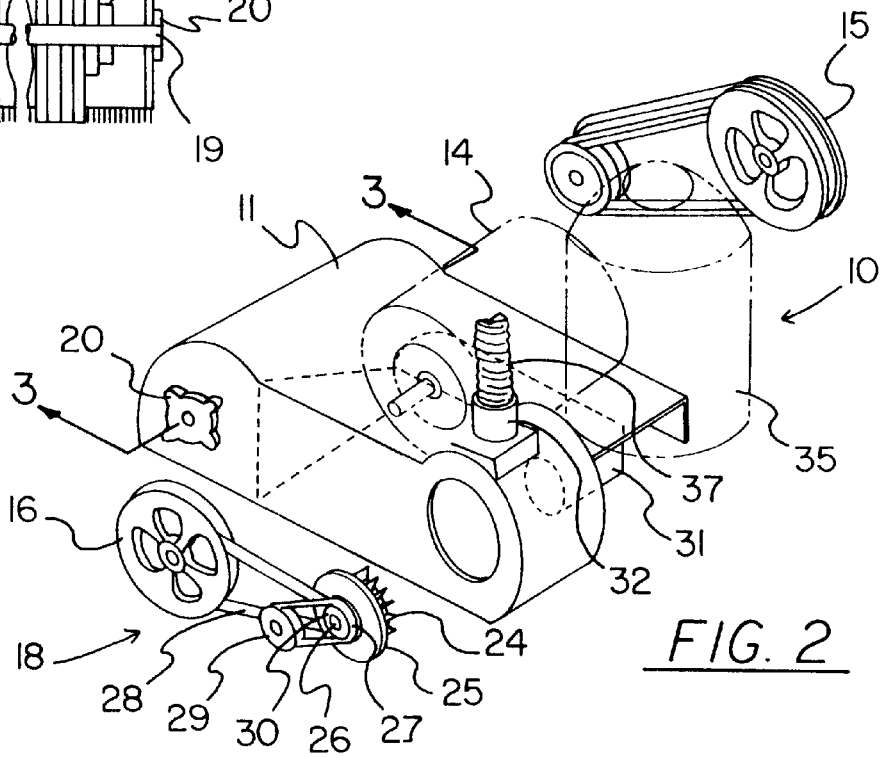
FIG. 2 is a rear perspective view of the present invention partially exploded to show its essential features.

With reference now to the drawings, and in particular to FIGS. 1 through 3 thereof, a new vacuumatic concrete planer embodying the principles and concepts of the present invention and generally designated by the reference numeral 10 will be described.

As best illustrated in FIGS. 1 through 6, the vacuumatic concrete planer 10 comprises a housing 11 having a pair of wheels 12 mounted on its opposing sides. A motor 14 is mounted over the housing 11. The motor 14 has a pair of pulleys 15,16 keyed to the opposed ends of its shaft (not shown) which drive a grinder blade assembly 17 and a vacuum blower assembly 18.

The blower assembly 18 comprises a plurality of blower blades 24 mounted on hub 25 which in turn is keyed to a shaft 26. The shaft 26 is rotatably supported within the rear portion of the housing 11 by suitable bearings (not shown). The shaft 26 extends from the housing 11 and one driven pulley 27 is keyed to this extension.

An endless belt 28 connects one drive pulley 16 of the motor to the driven pulley 27 of the vacuum blower assembly 18. An idler pulley 29 of the vacuum blower assembly 18 is held on the housing 11 by a bracket 30 standing in the way of the belt 28 on the driven pulley 27.

An tube 31 connects the grinder blade assembly 17 with the vacuum blower assembly 18. A discharge spout 32 is mounted over the housing 11 in communication with the vacuum blower assembly 18.

A post 33 is mounted over the rear portion of the housing 11 to guide the direction of the planer 10. A control box 34 which houses the electrical control mechanism of the planer is mounted on the post 33.

The improvement provided by the present vacuum concrete planer 10 resides on a vacuum cleaner 35 mounted on a frame 36 which in turn is attached to one side of the housing 11, opposing the drive pulley 16. The suction hose 37 of the vacuum cleaner 34 is attached to the discharge spout 32. The vacuum cleaner 35 is electrically connected to the control box 34 to permit a user to selectively activate it either off or on.

Another improved feature of the present vacuum concrete planer resides on the grinder blade assembly 17. The grinder blade assembly 17 comprises a shaft 19 which is supported on the front portion of the housing 11 by a suitable bearing 20. A plurality of disc shaped cutting stones 21 are keyed to the shaft 19. Each of the disc shaped cutting stones 21 are laminated and fiberglass reinforced and are secured on the shaft 19 by counter balancer washers 40 and lock nuts 41. The housing 11 has an open bottom portion at its front wherein the lower ends of the cutting stones 21 protrude to engage with the surface of concrete or marble slabs.

In use, when the motor 14 is activated, the grinder blade assembly 17 and the vacuum blower assembly 18 operate. The post 33 guides the planer 10 to move forward towards the surface to be ground or polished. The vacuum cleaner 35 sucks all the dust, whether wet or dry, discharged by the vacuum blower assembly 18. The laminated and fiberglass-reinforced cutting stones 21 pave the surface to be polished and conveys the dust to the vacuum blower assembly 18 and to the vacuum cleaner 35.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. In the construction of a vacuumated concrete planer comprising a wheeled housing having a motor mounted thereon, a grinder blade assembly disposed at the front end of said housing and a vacuum blower assembly disposed at the rear end of said housing, said grinder blade assembly and said vacuum blower assembly being operated by said motor through pulleys and belts provided thereon, the improvement wherein said grinder blade assembly comprising a shaft being held rotatably within said housing by suitable bearings, a plurality of laminated and fiberglass reinforced disc-like cutting stones keyed to said shaft and protruding from an open bottom portion of said housing, said stones being securedly held on said shaft by opposing counter balance washers and lock nuts and a vacuum cleaner mounted on one side of said housing, said vacuum cleaner having a suction hose being in communication with the said vacuum blower assembly.

2. A vacuumated concrete planer, comprising:

a wheeled housing;

a motor being mounted to said housing;

a grinder blade assembly being disposed towards the front end of said housing;

a vacuum blower assembly being disposed towards the rear end of said housing, said grinder blade assembly and said vacuum blower assembly being operated by said motor through pulleys and belts being provided thereon;

wherein said grinder blade assembly comprising a shaft being held rotatably within said housing by suitable bearings;

a plurality of laminated and fiberglass reinforced disc-like cutting stones keyed to said shaft and protruding from the open bottom portion of said housing, said stones being securely held on said shaft by opposing counter balance washers and lock nuts; and a vacuum cleaner having a suction hose, said vacuum cleaner being mounted to said housing, said suction hose being in communication with said vacuum blower assembly.

3. A vacuumated concrete planer, comprising:

a wheeled housing;

a grinder blade assembly being for paving and grinding of concrete and stone surfaces;

a vacuum blower assembly being in communication with said grinder blade assembly, said vacuum blower assembly being for sucking dust and other particles from said grinder blade assembly; and a vacuum cleaner having a suction hose, said vacuum cleaner being mounted to said housing, said suction hose being in communication with said vacuum blower assembly, said vacuum cleaner being for sucking and collecting dust and particles being expelled by said vacuum blower assembly.

4. The vacuumated concrete planer of claim 3, wherein said grinder blade assembly further comprises a shaft being held rotatably within said housing by suitable bearings and wherein a plurality of laminated and fiberglass reinforced disc-like cutting stones being mounted to said shaft and protruding from the open bottom portion of said housing, said cutting stones being for permitting individual replacement of said cutting stones when one of said stones becomes worn out.

5. The vacuumated concrete planer of claim 4, wherein said stones are securely held on said shaft by opposing counter balance washers and lock nuts for helping permit easy removal of any said cutting stones individually.

6. The vacuumated concrete planer of claim 3, wherein said grinder blade assembly is disposed towards the front end of said housing.

7. The vacuumated concrete planer of claim 3, wherein said vacuum blower assembly is disposed towards the rear end of said housing.

8. The vacuumated concrete planer of claim 3, further comprising a motor, said grinder blade assembly and said vacuum blower assembly being operated by said motor through pulleys and belts being provided thereon.

9. The vacuumated concrete planer of claim 8, wherein said motor is mounted to said housing.

* * * * *